US006544092B1

(12) United States Patent
Tomas

(10) Patent No.: US 6,544,092 B1
(45) Date of Patent: Apr. 8, 2003

(54) TOY ORNITHOPTER AIRCRAFT

(76) Inventor: Eric Edward Tomas, 456 Oakfield Crescent, Waterloo, Ontario (CA), N2T 1X5

( * ) Notice: Subject to any disclaimer, the term of this patent is extended or adjusted under 35 U.S.C. 154(b) by 0 days.

(21) Appl. No.: 10/245,696

(22) Filed: Sep. 18, 2002

(51) Int. Cl.[7] ..... A63H 27/00
(52) U.S. Cl. ..... 446/35; 446/486
(58) Field of Search ..... 446/34, 35, 486; 244/22, 72

(56) References Cited

U.S. PATENT DOCUMENTS

| | | | | | |
|---|---|---|---|---|---|
| 781,104 | A | | 1/1905 | Slinn | |
| 1,758,178 | A | | 5/1930 | Slinn | |
| 1,907,887 | A | * | 5/1933 | Spencer | 446/35 |
| 2,504,567 | A | | 4/1950 | Morgan | |
| 2,814,907 | A | | 12/1957 | Sears | |
| 2,859,553 | A | | 11/1958 | Spencer | |
| 3,626,555 | A | | 12/1971 | Albertini et al. | |
| 4,155,195 | A | | 5/1979 | Leigh-Hunt | |
| 4,195,438 | A | | 4/1980 | Dale et al. | |
| 4,729,748 | A | | 3/1988 | Ruymbeke | |
| 5,163,861 | A | | 11/1992 | Ruymbeke | |
| 5,194,029 | A | * | 3/1993 | Kinoshita | 446/35 |
| 6,227,483 | B1 | | 5/2001 | Therriault | |

* cited by examiner

*Primary Examiner*—Jacob K. Ackun
(74) *Attorney, Agent, or Firm*—Anthony Asquith & Co.

(57) ABSTRACT

The fuselage or airframe is a solid, characterised as two-dimensional, plastic moulding. The flapping wings pivot at the inner ends both to a pin on the airframe. Connecting-rods go from the crankshaft to intermediate points on the wings. The various pivot connections are made by snapping resilient split sockets onto respective pins, so no tools or fasteners are needed. Designed thus, the aircraft can be manufactured in kit form, wherein all the required plastic components are formed together in a single injection, the components being detached for final assembly.

12 Claims, 7 Drawing Sheets

54
58
57
56

60

FIG. 9
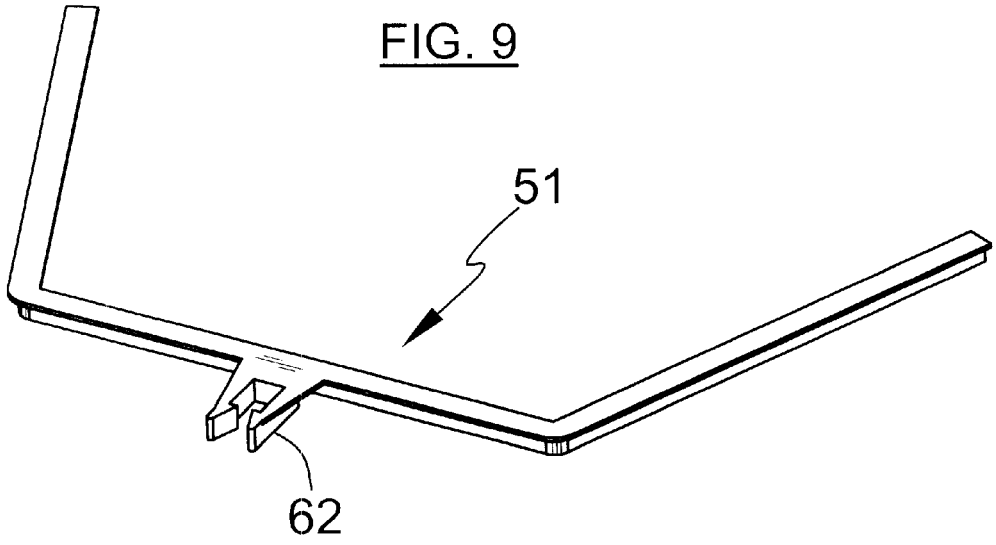
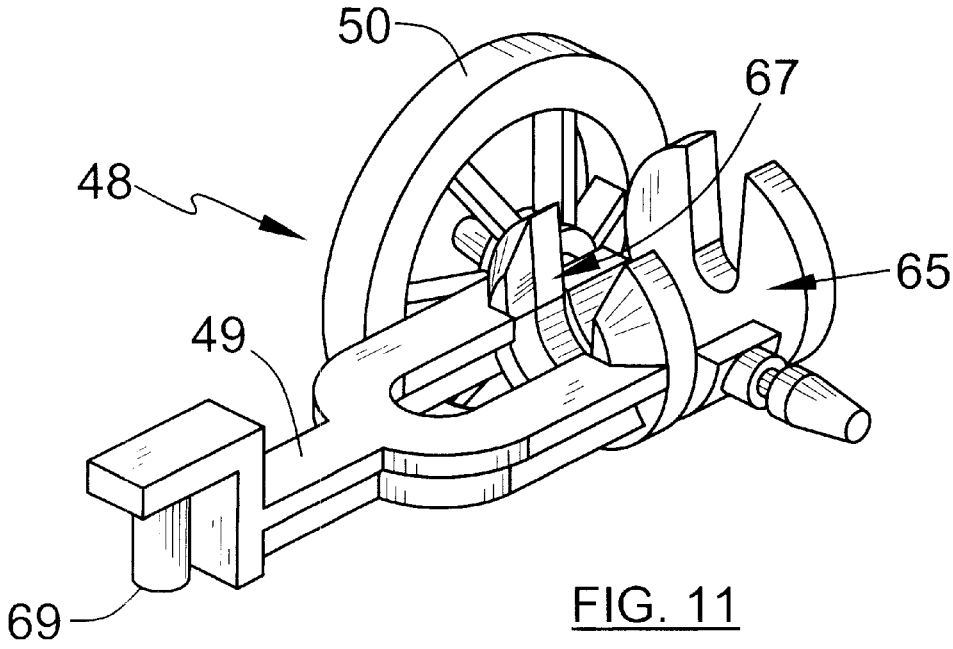
FIG. 11

TOY ORNITHOPTER AIRCRAFT

This invention relates to a model or toy aircraft, in which lift and propulsion of the craft is derived from flapping wings, more or less like a bird. Such a craft is commonly termed an ornithopter.

Traditionally, an ornithopter is powered by means of a rubber drive-band. The arrangement is that a person stores energy in the drive-band by progressively twisting the band. The stored energy is applied to the wings when the person releases the band.

BACKGROUND TO THE INVENTION

Ornithopters have developed into two categories, being the adult model category and the children's toy category.

There are ornithopter hobby clubs for adult enthusiasts of flapping flight. The adult ornithopter is characterised as very light, but very fragile, being made of balsa wood, etc.

The children's toy model is (has to be) much more robust, and consequently the toy version of the ornithopter is generally heavier. Slow-flapping wings would not produce enough lift for the (heavy) toy, and so the designer has to see to it that the wings flap at rather high speed. Even so, the flight characteristics of the traditional toy ornithopter are rather poor. The toy aircraft tend to fly erratically, and tend to stall, not glide, when the power runs out. When the ornithopter is flown indoors, by a child, the associated adults may become irritated by the fast-flapping device in the confined space.

An aim of the invention is to provide a children's toy ornithopter aircraft that is robust enough to stand up to being handled and operated by children, yet which is light in weight and aerodynamically sound enough that the flap speed can be relatively slow, whereby the aircraft can be flown indoors in a pleasurable manner.

It is an aim of the invention to provide a children's toy ornithopter that is educational, being open as to its structure, whereby the child user can readily observe and understand the mechanism that leads to powered flight.

THE INVENTION IN RELATION TO THE PRIOR ART

A small ornithopter of the children's-toy type, with which the invention is concerned, is shown in patent publication U.S. Pat. No. 781,104 (1905, Slinn). Also relevant is U.S. Pat. No. 5,163,861 (1992, van Ruymbeke).

In the aircraft depicted by Van Ruymbeke, the airframe of the aircraft comprises a hollow fuselage. The left and right wings are pivoted at wing pivot-points that are structured into the left and right side walls of the fuselage, whereby the wing pivot-points lie each a centimetre or so from the axis of the aircraft, i.e the left and right pivot-points are spaced about two cm apart.

In Van Ruymbeke, the wings have respective inward-extending stubs, which extend almost to the axis of the aircraft. The inner ends of these stubs connect to left and right connecting-rods of the drive mechanism; as the stubs are driven upwards, so the wings pivot about their pivot-points, and so the main, outer, portions of the wings are driven downwards.

The aircraft depicted by Slinn has, by contrast, a solid (i.e not hollow) fuselage. In Slinn, the wings are mounted and driven in a manner that might be noted as opposite to the manner shown in Van Ruymbeke, in that, in Slinn, the wings are pivoted to the (solid) fuselage at the wing's inner extremity, not at an intermediate point. In Slinn, the left and right crank-arms are provided by the wire frame 13,14, which drives the wings up/down as it rotates.

It may be noted that, in Slinn, the wire components slide over each other in a manner that gives rise to a good deal of rubbing friction, and this design must be regarded as being very poorly engineered.

The drive mechanism of Van Ruymbeke is much more complex, but one benefit is that the forces are applied at more advantageous angles, and there is much less inherent friction associated with converting the energy stored in the coiled rubber band into up/down flapping motions of the two wings.

It may be noted that the pivoting wings of Van Ruymbeke are a different class of lever from the pivoting wings of Slinn. Where the wing pivots at an intermediate point, as in Van Ruymbeke, the force on the connecting-rod is the sum of the force on the wing pivot plus the lift force developed by the wing. Where the wing pivots at its inner end, as in Slinn, the force on the connecting-rod is the difference between those two forces. Therefore, when the wings are pivoted at their inner ends, the forces and frictions associated with the movements of the connecting-rod are reduced.

It is an aim of the invention to achieve a wing-flapping mechanism that is very simple, and yet robust, and is inherently of low friction. The aim is to provide an aircraft which, though robust, flaps better, i.e more slowly, and to achieve this by the arrangement of the components, whereby robustness need not be severely compromised in order to achieve lightness of weight.

It is also an aim of the invention to provide a kit, which can be assembled into an ornithopter aircraft, by a young person, without fasteners, and without the use of tools.

DETAILED DESCRIPTION OF PREFERRED EMBODIMENTS

By way of further explanation of the invention, exemplary embodiments of the invention will now be described with reference to the accompanying drawings, in which:

FIG. 9 shows a tail-frame component of the aircraft of FIG. 1.

FIG. 11 shows an undercarriage sub-frame component and one of two wheels of the aircraft of FIG. 1.

The apparatuses shown in the accompanying drawings and described below a re examples which embody the invention. It should be noted that the scope of the invention is defined by the accompanying claims, and not necessarily by specific features of exemplary embodiments.

Figure 1:
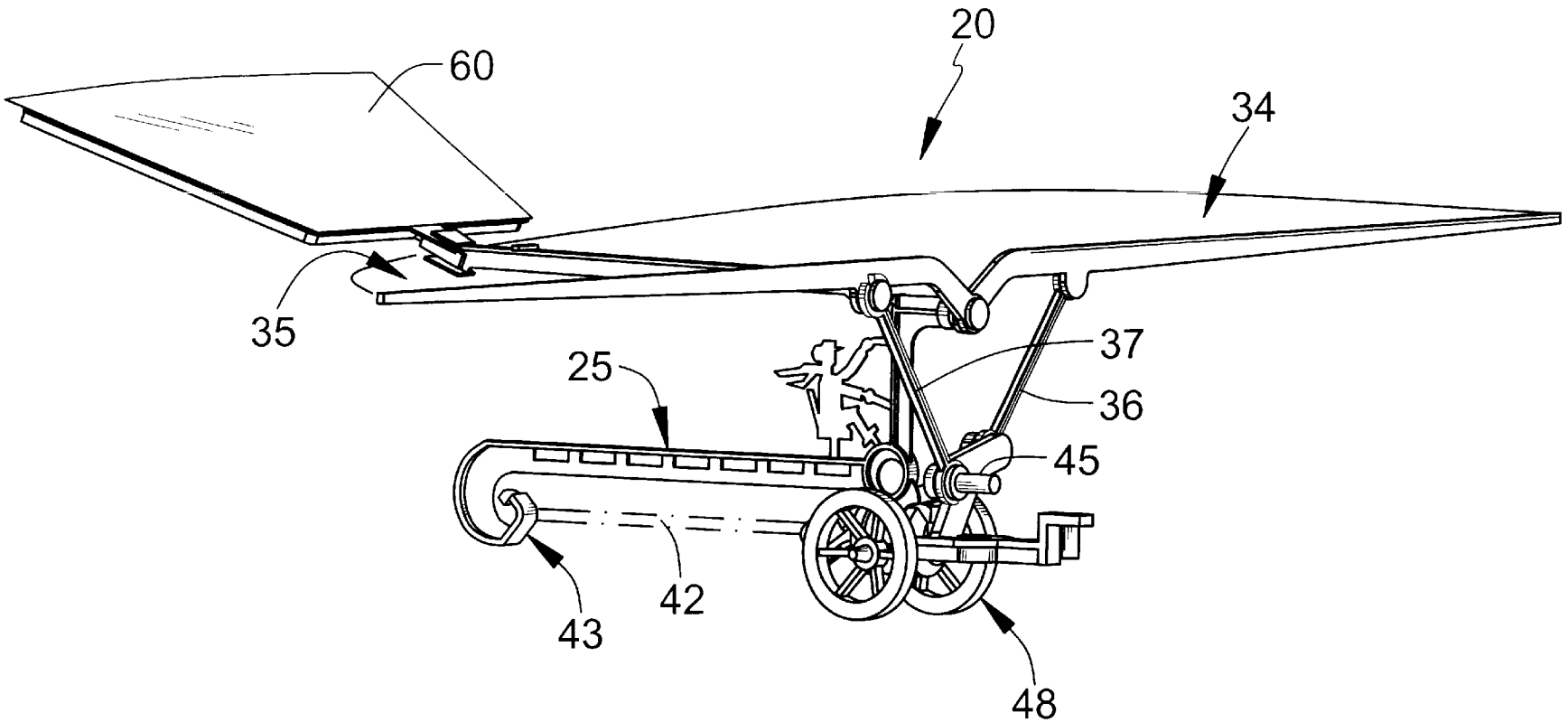
FIG. 1 is a pictorial view of an ornithopter aircraft that incorporates the invention, with undercarriage attached.
Figure 2:
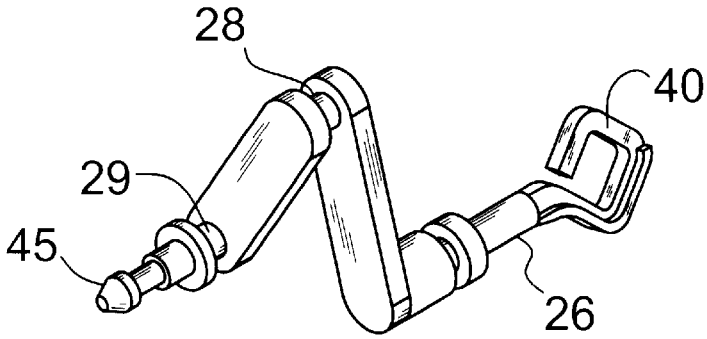
FIG. 2 shows a crankshaft component of the aircraft of FIG. 1.
Figure 3:
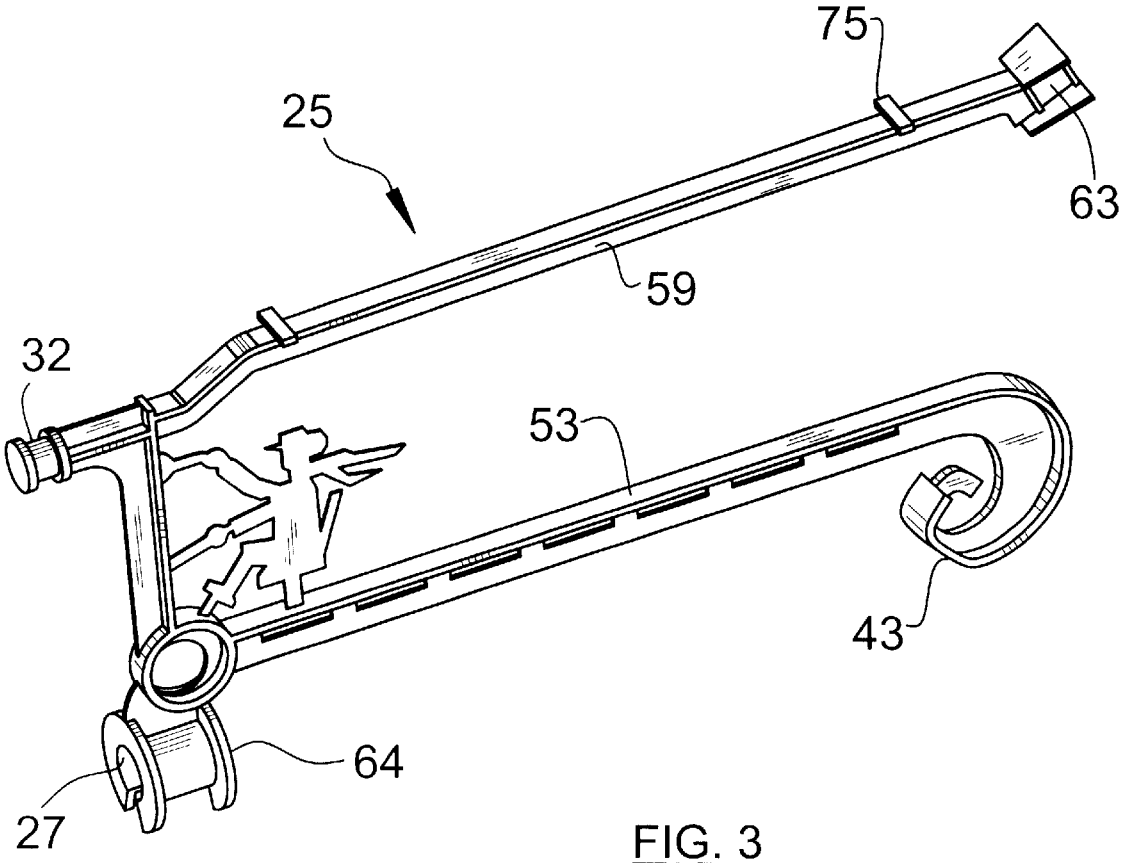
FIG. 3 shows an airframe component of the aircraft of FIG. 1.
Figure 5:
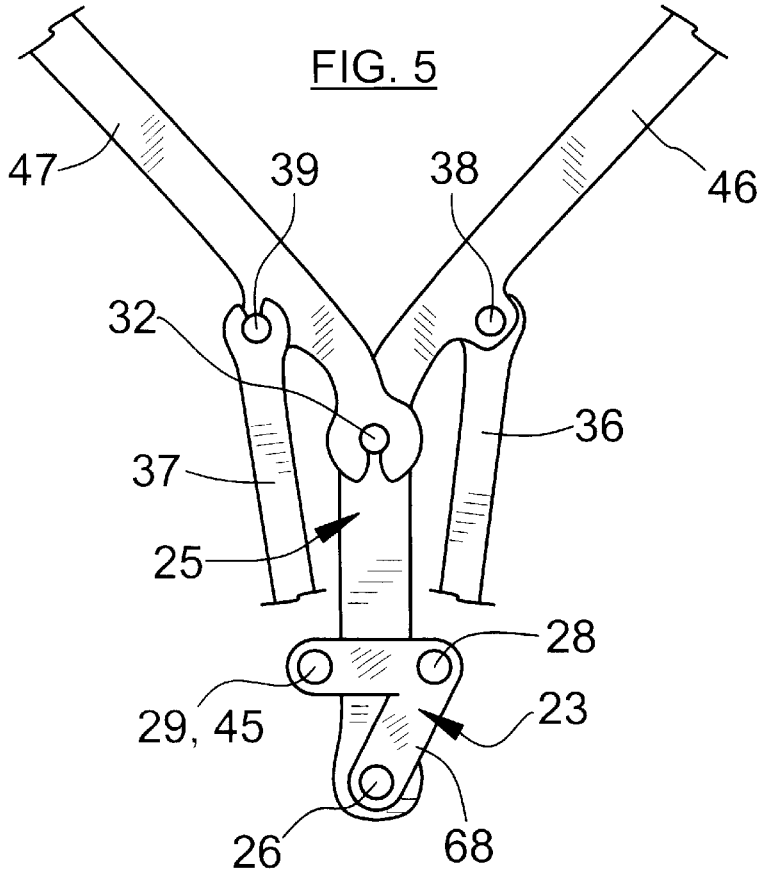
FIG. 5 is an end-view of the crankshaft, and shows the connecting-rods assembled thereto.

FIG. 1 shows the ornithopter aircraft 20 assembled. The drive mechanism of the aircraft includes a crankshaft 23 (FIG. 2). The crankshaft has a main-bearing, which defines the axis of rotation of the crankshaft 23 relative to the airframe 25 of the aircraft (FIG. 3). The main-bearing is defined by a main-bearing-pin 26 on the crankshaft 23, which engages with a corresponding main-bearing-socket 27 in the airframe 25.

Figure 4:
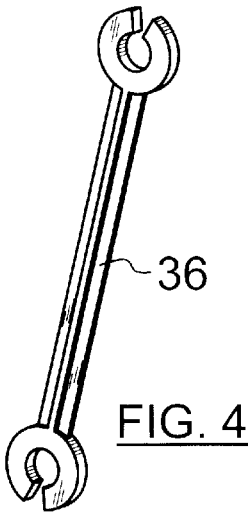
FIG. 4 shows one of two connecting-rod components of the aircraft of FIG. 1.

The crankshaft 23 is shaped to include two crank-pins 28,29. Crank-pin 28 drives the left wing 34, and crank-pin 29 drives the right wing 35. Left and right connecting-rods 36,37 (FIG. 4) run from the crank-pins 28,29 to coupling-points 38,39 on the left and right wings 34,35. The wings pivot about a wing-pivot-pin 32 on the airframe.

The two crank-pins 28,29 on the crankshaft 23 are offset from each other some thirty degrees apart, relative to the axis of the crankshaft main-bearing. Both crank-pins 28,29 are the same radial distance from the axis of the crankshaft 23, as defined by the main-bearing. The geometry of the arrangement is such that, as the crankshaft rotates, the two wings are driven to rise and fall in mirror-unison, relative to the airframe.

The rear end of the crankshaft 23 terminates in a drive-hook 40. The rubber drive-band 42 that powers the aircraft is received onto the drive-hook 40. The other end of the drive-band 42 is received on a reaction-hook 43 moulded into the airframe 25.

To power up the aircraft, a person holds the airframe 25 in one hand, and commences to rotate the crank-handle 45. It will be noted that the crank-handle 45 is co-axial with the crank-pin 29 associated with one of the wings, in this case the right wing 34. Thus, the crank-handle 45 is offset radially from the main axis.

When the drive-band has been twisted to its fullest extent, the aircraft is now set for flight. The person holds the aircraft in such manner as to prevent the wings from flapping, and then, with a slight forward push, lets go the aircraft. The wings flap at a speed of two or so flaps per second, which not only is slow enough to be sociable indoors, but is slow enough that a sharp-eyed young person can even follow the motion of the wings, and thereby can achieve some insight and feel for the mechanics of flight.

Figure 6:
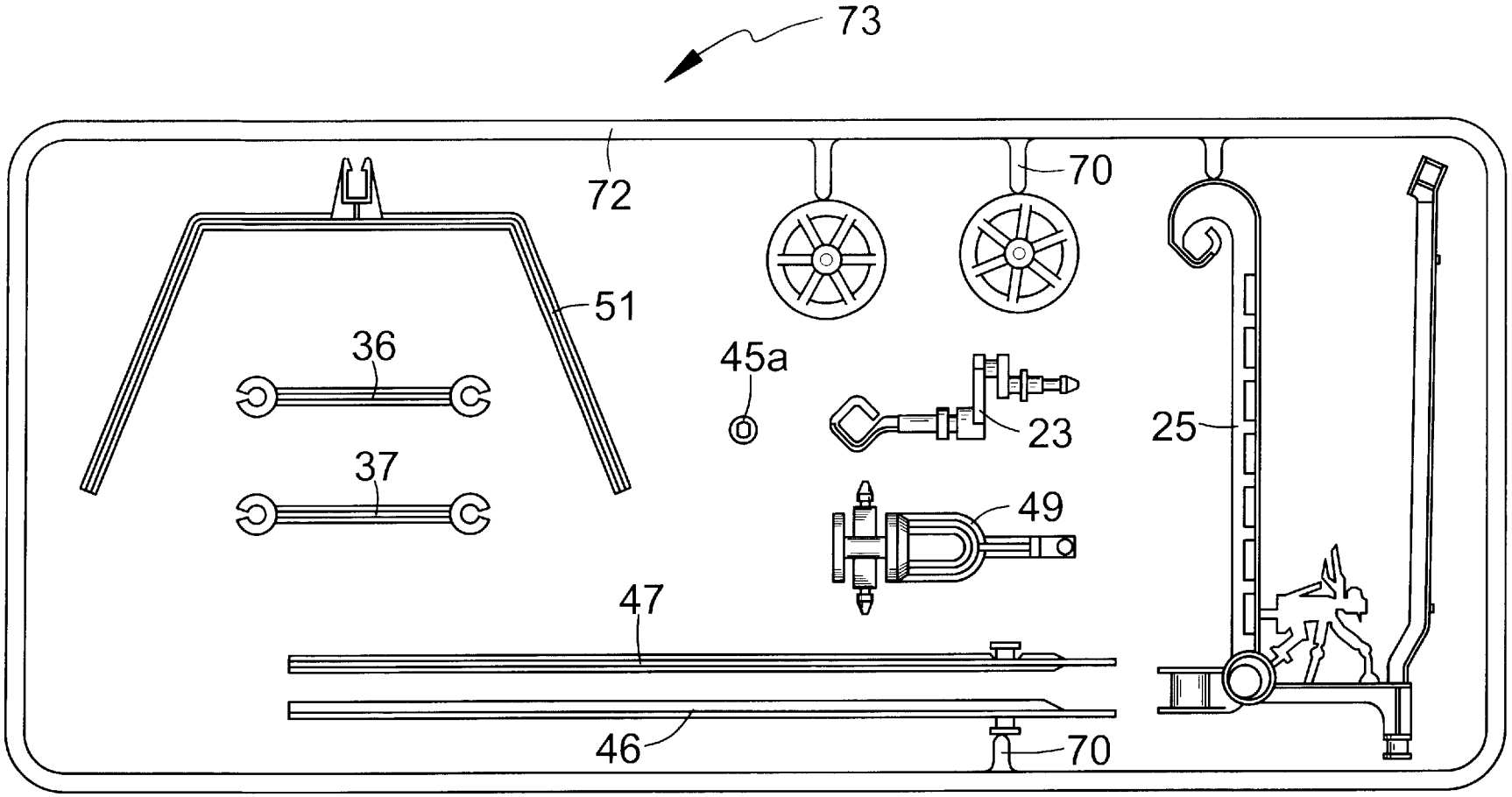
FIG. 6 is a view of all the moulded plastic components of the aircraft of FIG. 1, done as a single injection.

The components of the aircraft are shown separately, as a kit, in FIG. 6. The components are:

the fuselage or airframe 25;

left and right wing-spars 46,47;

left and right connecting-rods 36,37;

a tail-frame 51;

a crankshaft 23;

a crank-handle-sleeve 45*a*

The crank-handle-sleeve 45*a* snaps over the crank-handle 45, and is rotatable thereon, to make turning the crankshaft easier.)

In addition, an undercarriage 48 is included in the ornithopter kit. The undercarriage includes:

a sub-frame 49;

left and right ground-wheels 50.

It will be understood that the above components can all be injection-moulded, in plastic, in a single injection. That is to say, all the plastic moulded components for one ornithopter aircraft are contained all in one unitary moulding.

In addition, the whole ornithopter also includes:

a wing-sheet 54, for forming the left and right wings 34,35;

a tail-sheet 52;

the rubber drive-band 42.

It will be noted that the plastic components are designed to be snapped together, whereby no fasteners are needed to hold the aircraft together, and no tools are required for its assembly.

The moulded airframe 25 includes a drive-band-reaction-strut 53. When the drive-band 42 is twisted, of course the airframe must provide a torsional reaction to the torque produce by the drive-band, but also, as it is twisted, the drive-band becomes shorter, giving rise to a force tending the draw the drive-hook 40 on the crankshaft 23 towards the reaction-hook 43 on the airframe In fact, this tensile force exerted by the twisted rubber drive-band can be quite large, and the airframe must be robust enough to counter it. The drive-band-reaction-strut is provided for this purpose.

Preferably, as shown, the drive-band-reaction-strut 53 is a solid strut, lying alongside the drive-band rather than e.g. a hollow tube surrounding the drive-band, in order that the user (intentionally a child) has easy access for attaching the band to the hooks, and can easily see what is going on.

Figures 7, 10:
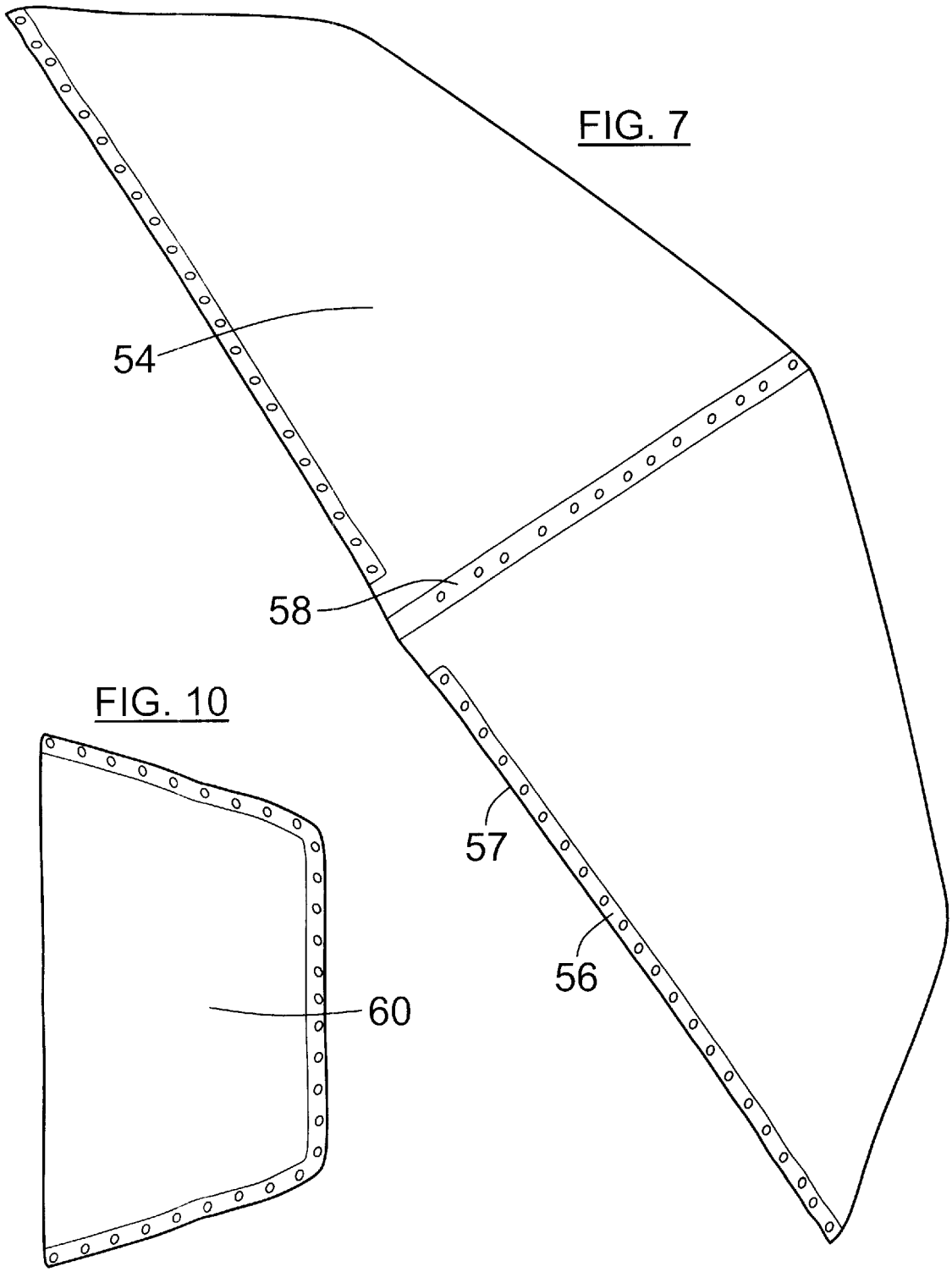
FIG. 7 shows a wing-sheet component of the aircraft of FIG. 1.
FIG. 10 shows a tail-sheet component of the aircraft of FIG. 1.
Figure 8:
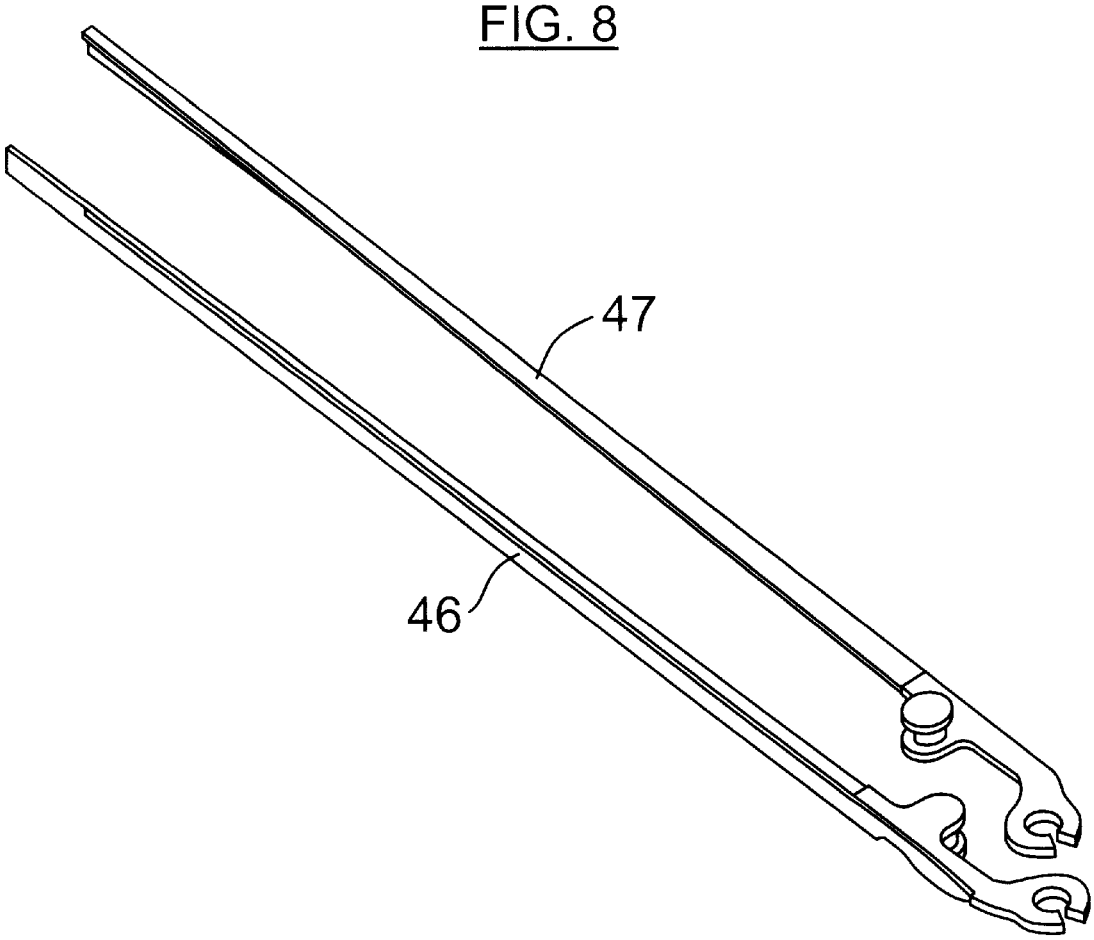
FIG. 8 shows left and right wing-spar components of the aircraft of FIG. 1.

The left and right wings 34,35 are formed from the wing-sheet 54, which is of thin plastic film. The profile of the wing-sheet is shown in FIG. 7. The wing-sheet 54 is provided with a line 56 of adhesive, for securing the leading edge 57 of the wing-sheet to the left and right wing-spars 46,47 (FIG. 8), and with a line 58 of adhesive, for securing the centre of the wing-sheet to the spine-member 59 of the airframe 25. The lines of adhesive may comprise spots or dabs of adhesive, which, in the kit as manufactured, are covered by protective tape, the tape being removed just prior to final assembly by the purchaser.

The wing-sheet 54 is attached to the wing-spars 46,47, and the wing-sheet thus extends rearwards from the tops of the wing-spars. Thus, the shape of the resulting wing has at least the rudiments of an aerofoil, which assists its aerodynamic performance.

Of course, some care is needed, to lay out the wing-sheet 54 properly to the spine-member 59 and wing-spars 46,47, but the task can be done by a child.

The tail of the aircraft is formed from a tail-frame 51 (FIG. 9), and from a tail-sheet 60 (FIG. 10) of thin plastic film. Preferably, the tail-frame 51 is, as shown, moulded as a separate component from the airframe 25, and is secured to the airframe by means of a clip 62 that snaps into a complementary socket 63 in the rear end of the spine-member 59 of the airframe.

As mentioned, preferably, the aircraft 20 is accompanied by an undercarriage 48. The undercarriage comprises a sub-frame 49, having wheels 50 (FIG. 11). The airframe 25 includes a boss 64 (in which the main-bearing-pin 26 is received internally), and the boss 64 is shaped externally to receive the sub-frame 49. The sub-frame includes a socket 65, which fits snugly around the boss 64.

The sub-frame 49 is provided with a slot 67, which, when the sub-frame is assembled onto the boss, receives the crank-arm 68 of the crankshaft 23. As such, when the sub-frame is in place on the airframe, the crankshaft is held against rotation.

After the crank-handle 45 has been turned, and the rubber drive-band 42 has been wound up, the person slips the sub-frame 49 onto the boss 64 of the airframe, to lock the crankshaft against rotation. The aircraft can now be made ready for launching, by looping a rubber launch-band (not shown) around a launch-post 69 moulded into the sub-frame 49. The person releases the aircraft, which catapults forwards by the action of the launch-band. The sudden movement knocks the sub-frame 49 clear, whereupon the crankshaft 23 can now rotate, and the wings start to flap, and powered flying commences. Preferably, a catapult structure is provided (not shown), which is formed with a launch track for the undercarriage sub-frame, and which includes a trigger mechanism for a crisp release of the aircraft. However, the undercarriage 48 might also be provided simply as a stand, for displaying the aircraft when not in use.

During flight, the rubber drive-band 42 gradually untwists, causing the crankshaft 23 to rotate. At the end of a flight, the twist remaining on the rubber drive-band is no longer enough, and the crankshaft stops.

The torque on the crankshaft, as provided by the twisted rubber drive-band, falls gradually to zero as the drive-band unwinds; however, it may be noted that the torque does not vary as a function of the rotation al position of the crankshaft, i.e the torque on the shaft does not depend on whether the wings are up, or down, or horizontal. But the frictional and the aerodynamic resistances to the rotation of the crankshaft, both do vary, in accordance with the orientation of the wings. Naturally, the aerodynamic resistance is a maximum when the wings are straight out, i.e horizontal. Also, the frictional resistance is at a maximum at that orientation, too.

If the geometry of the wing drive mechanism, and the friction, were constant all around the revolution of the crankshaft, then, as the twist of the drive-band ran out, so the wings would fold together; and, with the wings together, the aircraft would have no lift, and would drop to the ground.

What actually happens is that, when there is no more twist left in the drive-band, the wings settle to the horizontal (FIG. 1) position. That is to say, the crankshaft 23 settles to the orientation at which the wings 34,35 are horizontal. It does this because of the geometry of the drive mechanism, which gives quite markedly different resistance to the rotary motion of the crankshaft in accordance upon the orientation of the crankshaft.

Figure 12:
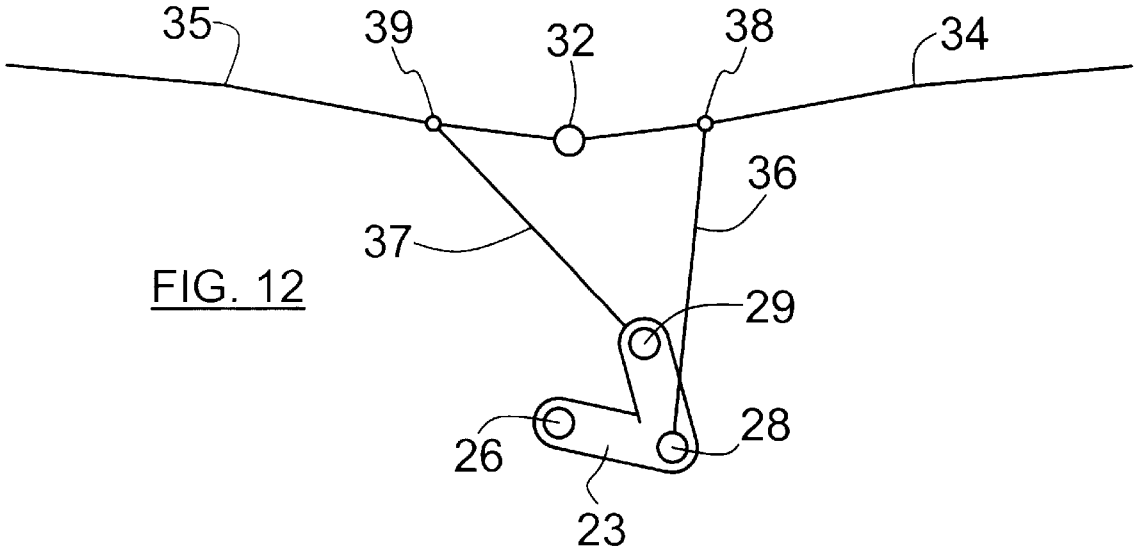
FIG. 12 is a diagram illustrating a particular orientation of the crankshaft of the aircraft of FIG. 1.

The drive mechanism, including the crankshaft 23 and the connecting-rods 36,37, is such that, when the wings are horizontal, the resistance opposing the coming-together of the wings 34,35 is quite large. Indeed, the resistance is large enough that it cannot be overcome by the weight of the aircraft acting on the wings. The torque needed to drive the wings through the extreme wings-up or wings-down positions is less than the torque needed to drive the wings through the wings-horizontal position. This is because the geometry of the drive arrangement is such that the effective lever arm length at which the connecting-rods act is at maximum in the wings-horizontal position, and at a minimum in the wings-up or wings-down positions. Thus, an almost-spent drive-band can force the wings through the wings-up and the wings-down positions, but not through the wings-horizontal position. As a result, when the rubber band runs out, the wings come to rest in the horizontal position, whereby the aircraft remains right-way-up, and maintains a reasonable angle of descent as it glides to a smooth landing. In fact, usually, the wings come to rest pointing slightly upwards in a slight V-shape, which gives a positive dihedral effect, for stable gliding flight. The orientations of the various components of the drive mechanism at which the mechanism normally comes to rest, are shown in FIG. 12.

As mentioned, the plastic components of the aircraft are moulded together, in a single injection (FIG. 6), and remain attached by their moulding sprues 70 to a moulding-bar 72. The single moulding can remain as one piece, the components being left attached together, to be detached only by the user upon final assembly. This keeps the aircraft's moulded components together, as a set, while the kit is being made up, which simplifies inventory. Thus, the kit comprises, as a production item, only four separate entities, being the single moulding, the wing sheet, the tail sheet, and the rubber drive-band. Not only does this make the kits simple to compile, but the items can be packed more or less flat, whereby the kit can be contained easily in an envelope, and a stack of the kits takes up only minimal space.

In the aircraft depicted herein, the components and pieces are not chunky, but may be characterised as flat and thin. Also, the largest moulded component, i.e the airframe 25, should be regarded as basically a two-dimensional rather than a three-dimensional structure. This is advantageous in that, again, it enables all the components, including the airframe 25, to be injection-moulded, in plastic, at a single injection.

When the drive-band 42 is fully coiled and twisted, the airframe 25 has to resist not only the torsional force that is the reaction to the torque the drive-band is exerting on the crankshaft 23, but also the coiled drive-band exerts a tensile force, drawing the hooks 40,43 together, and the airframe has to provide a reactive force to counteract that tensile force also, and that is the drive-band-reaction-strut 53 of the airframe. This strut is offset, of course, from the line of the drive-band, and so is stressed in bending, and the strut is beam-shaped, to counter the bending.

The airframe, and especially the drive-band-reaction-strut 53 of the airframe, has to be robust and rigid. The traditional hollow fuselage has good strength and rigidity, but very poor accessibility to the contents inside, both visually and for hand manipulation. It is recognised that the airframe need not be hollow to be rigid enough, and now, young persons can directly see the drive-band, and can observe, and hopefully understand, what it does. The rubber drive-band 42 is exposed, and access to the drive-band, for assembly and repair, is very simple.

It is recognised that the structure as depicted herein combines the required degree of structural robustness with sufficient lightness to enable the aircraft to fly with pleasantly-slowly flapping wings, with the ability for the components to be moulded all in a single injection.

The airframe is show n as on e piece. Alternatively, the airframe could be in two (or more) actual pieces. But if so, the pieces should again be co-moulded, and should be arranged to snap together. The other components, similarly, may be in separate pieces.

As mentioned, it is intended that the aircraft should be assembled, from the kit, by a child. However, a child might encounter difficulty, when gluing the wing-sheet 54 to the wing spars 46,47 and to the spine-member 59 of the airframe 25, in aligning and positioning the wing-sheet symmetrically, without wrinkles, etc. And, once the wing-sheet has been glued to the wing-spars, really it cannot be re-positioned.

So, in an alternative construction, the wing-sheet is pre-attached to the wing-spars (i.e attached as a factory operation). Thus, the child is spared the demanding task, of ensuring the wing-sheet is correctly aligned just as the adhesive makes contact.

The wing-sheet is not however pre-glued to the spine-member. A button 75 on the spine-member 59 engages a buttonhole formed at the corresponding location, in the material of the wing-sheet. Thus, the wing-sheet is pre-glued along its forward edge to the left and right wing-spars: the child attaches the wing to the airframe by snapping the wing-spars onto the wing-pivot-pin 32, and by snapping the buttonhole in the wing-sheet over the button 75.

Similarly, the material 60 of the tail may be pre-glued to the tail-frame 51, as a factory operation.

What is claimed is:

1. An ornithopter aircraft, having an airframe, and having left and right flapping wings, wherein:

the airframe comprises a solid plastic moulding;

the wings include respective wing-spars, which have respective pivot-elements at their inner ends, and respective connecting-rod-receiving elements at intermediate points;

the solid airframe includes pivot-mountings, which are complementary to the pivot-elements in the wing-spars;

the aircraft includes a crankshaft, having a main-bearing-connection with the airframe;

the main-bearing-connection defines an axis of rotation of the crankshaft relative to the solid airframe;

the crankshaft includes left and right crank-pins, which are parallel to, and radially spaced from, the main-bearing axis, the left crank-pin being angularly spaced from the right crank-pin, around the main-bearing axis;

the aircraft includes left and right connecting-rods, which connect respectively with the connecting-rod-receiving elements in the left and right wing-spars, and with the left and right crank-pins on the crankshaft;

one of the crank-pins extends forwardly, and thereby forms a crank-handle;

the crank-handle extends forwards with respect to the aircraft;

the arrangement of the aircraft is such that a person may grip the crank-handle, at the front of the aircraft, and thereby apply rotation to the crankshaft;

the crankshaft includes, at its rear end, a drive-hook, which is unitarily moulded into the crankshaft;

the airframe includes a corresponding reaction-hook, which is unitarily moulded into the solid airframe;

the aircraft is so structured that a line joining the hooks lies on the main-bearing axis;

the aircraft includes a drive-band, of elastomeric material;

the arrangement of the aircraft is such that, with the aircraft assembled and otherwise ready for flight, the person can, by finger manipulation, attach the drive-band over both hooks, and can then twist the drive-band by rotating the crank-handle.

2. The aircraft of claim 1, wherein, in respect of the solid airframe, the crankshaft, the left and right wing-spars, and the left and right connecting-rods:

the said components are all physically attached by respective moulding-sprues to a moulding-bar, the said components having been moulded all together in a single mould-injection;

the moulding-sprues are easily breakable for detachment of the components from the moulding-bar for final assembly.

3. Apparatus of claim 1, wherein:

the aircraft includes a wing-sheet, comprising a single piece of thin plastic film;

the one-piece wing-sheet is symmetrical about a front/rear axis, and is shaped to create the two wings, one to each side of the front/rear axis;

the one-piece wing-sheet has a leading-edge, and has a leading-margin which is contiguous with the leading-edge;

the aircraft includes means for adhering left and right portions of the leading-margin of the wing-sheet respectively to the left and right wing-spars;

the airframe includes a spine-member, which extends in a front/rear sense, and lies parallel to, and above, the said main-bearing axis;

the aircraft includes means for adhering a band portion of the wing-sheet, being a portion that lies on the said front/rear axis, to the spine-member.

4. Apparatus of claim 1, wherein:

the solid airframe includes a drive-band-reaction-strut;

the drive-band-reaction-strut is of a solid, chunky, robust structure, being structurally rigid enough, in the airframe, to react and support the twisting and tensile forces that act on the airframe as a result of the rubber drive-band being twisted;

the solid drive-band-reaction-strut lies spaced from, and generally parallel to, the line joining the hooks.

5. Apparatus of claim 1, wherein:

at the main-bearing connection between the airframe and the crankshaft, the crankshaft is formed with a main-bearing-pin, and the airframe is formed with a main-bearing-socket;

the main-bearing-socket is split, axially, and is so structured that the main-bearing-pin can be resiliently snapped into the main-bearing-socket by sideways pressure.

6. Apparatus of claim 1, wherein:

the pivot-mountings on the airframe comprise wing-pivot-pins;

the pivot-elements at the inner ends of the wing-spars comprise respective wing-pivot-sockets;

the wing-pivot-sockets are split, axially, and are so structured that the wing-pivot-pins can be resiliently snapped into the respective wing-pivot-sockets by sideways pressure.

7. Apparatus of claim 6, wherein the wing-pivot-pin in respect of the left wing, and the wing-pivot-pin in respect of the right wing, are co-axial.

8. Apparatus of claim 1, wherein:

the connecting-rod-receiving-elements on the wing-spars comprise conn-rod-pins;

the connecting-rods include respective conn-rod-sockets;

the conn-rod-sockets are split, axially, and are so structured that the conn-rod-pins can be resiliently snapped into the respective conn-rod-sockets by sideways pressure.

9. Apparatus of claim 1, wherein:

the connecting-rods include respective crank-sockets;

the crank-sockets are split, axially, and are so structured that the crank-pins on the crankshaft can be resiliently snapped into the respective crank-sockets by sideways pressure.

10. Apparatus of claim 1, wherein the aircraft includes a tail;

the tail comprises a tail-sheet of thin plastic film, and a tailframe, and a means for adhering the tail-sheet to the tailframe;

and the tail-frame includes a snap-together connection with the airframe.

11. Apparatus of claim 2, wherein:

at the main-bearing connection between the airframe and the crankshaft, the crankshaft is formed with a main-bearing-pin, and the airframe is formed with a main-bearing-socket;

the main-bearing-socket is split, axially, and is so structured that the main-bearing-pin can be resiliently snapped into the main-bearing-socket by sideways pressure;

the pivot-mountings on the airframe comprise wing-pivot-pins;

the pivot-elements at the inner ends of the wing-spars comprise respective wing-pivot-sockets;

the wing-pivot-sockets are split, axially, and are so structured that the wing-pivot-pins can be resiliently snapped into the respective wing-pivot-sockets by sideways pressure;

the wing-pivot-pin in respect of the left wing, and the wing-pivot-pin in respect of the right wing, are co-axial;

the connecting-rod-receiving-elements on the wing-spars comprise conn-rod-pins;

the connecting-rods include respective conn-rod-sockets;

the conn-rod-sockets are split, axially, and are so structured that the conn-rod-pins can be resiliently snapped into the respective conn-rod-sockets by sideways pressure;

the connecting-rods include respective crank-sockets;

the crank-sockets are split, axially, and are so structured that the crank-pins on the crankshaft can be resiliently snapped into the respective crank-sockets by sideways pressure.

12. Apparatus of claim 1, wherein some of the components of the aircraft are supplied in the form of a kit:

the kit includes a single-injection-moulding;

in the single-injection-moulding, the solid airframe, the crankshaft, the left and right wing-spars, and the left and right connecting-rods are all physically attached by respective moulding-sprues to a moulding-bar, the said components having been moulded all together in a single mould-injection, and the moulding-sprues are easily breakable for detachment of the components from the moulding-bar for final assembly;

the kit also includes a wing-sheet and a tail-sheet, of thin plastic film, and includes a means for adhering a leading edge of the wing-sheet to the left and right wing-spars;

and the kit also includes a rubber drive-band.

* * * * *